US007926518B2

(12) United States Patent
Debaes et al.

(10) Patent No.: US 7,926,518 B2
(45) Date of Patent: Apr. 19, 2011

(54) SYSTEM FOR SUPPORT OF THE CUTTING BENCH IN A FACE-TO-FACE WEAVING MACHINE

(75) Inventors: Johny Debaes, Moorslede (BE); Stéphan Vanneste, Rekkem-Menen (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 1182 days.

(21) Appl. No.: 11/174,834

(22) Filed: Jul. 5, 2005

(65) Prior Publication Data

US 2006/0000516 A1 Jan. 5, 2006

(30) Foreign Application Priority Data

Jul. 5, 2004 (BE) ..... 2004/0331

(51) Int. Cl.
*D03J 1/08* (2006.01)
*D03J 1/24* (2006.01)
*D03D 33/00* (2006.01)
*D03D 23/00* (2006.01)

(52) U.S. Cl. ..... 139/291 C; 139/291 R; 139/20; 139/21

(58) Field of Classification Search ..... 139/20, 139/21, 291 R, 291 C, 397, 394, 407
See application file for complete search history.

(56) References Cited

U.S. PATENT DOCUMENTS

| | | | | |
|---|---|---|---|---|
| 3,059,307 | A * | 10/1962 | Riddle | 26/12 |
| 3,877,119 | A * | 4/1975 | Gierse et al. | 26/9 |
| 4,261,391 | A * | 4/1981 | Hommes et al. | 139/21 |
| 4,478,255 | A | 10/1984 | Juillard | |
| 4,850,085 | A * | 7/1989 | Murasaki | 26/9 |
| 5,076,331 | A * | 12/1991 | Debaes | 139/291 C |
| 6,155,307 | A * | 12/2000 | Vanneste | 139/291 C |
| 6,213,159 | B1 * | 4/2001 | Debaes | 139/1 R |
| 6,817,383 | B2 * | 11/2004 | Debaes et al. | 139/21 |
| 6,837,274 | B2 * | 1/2005 | Debaes et al. | 139/21 |

FOREIGN PATENT DOCUMENTS

| | | |
|---|---|---|
| DE | 19534143 | 3/1996 |
| FR | 657094 | 5/1929 |

* cited by examiner

*Primary Examiner* — Bobby H Muromoto, Jr.
(74) *Attorney, Agent, or Firm* — James Creighton Wray

(57) ABSTRACT

A face-to-face weaving machine is disclosed, which includes a cutting bench to guide the movement of a cutting blade in order to cut a face-to-face fabric. The cutting bench is carried and/or supported at its extremities by the frame of the weaving machine. In at least one additional location between the cutting bench extremities, the cutting bench is carried and/or supported by the frame by way of one or more intermediate parts. A face-to-face weaving machine with a cutting bench that possesses sufficient stiffness to significantly reduce sagging of the cutting bench is thereby obtained.

9 Claims, 5 Drawing Sheets

SYSTEM FOR SUPPORT OF THE CUTTING BENCH IN A FACE-TO-FACE WEAVING MACHINE

This application claims the benefit of Belgian Application No. 2004/0331 filed Jul. 5, 2004, which is hereby incorporated by reference in its entirety.

BACKGROUND OF THE INVENTION

This invention relates to a face-to-face weaving machine comprising a cutting bench to guide the movement of a cutting blade in order to cut a face-to-face fabric, wherein said cutting bench is carried and/or supported at its extremities by the frame of the weaving machine.

In a face-to-face weaving machine, two fabrics are woven simultaneously one on top of another and they are connected to each other through pile warp yarns moving in a pattern -forming manner from the lower fabric to the upper fabric and vice versa.

Both fabrics are held at a distance from each other through the opening between the lower and upper cutting rod, provided that sufficient tension is put on the warp threads. Before being presented to the cutting movement, the non-separated face-to-face fabric will be kept apart over the distance between the upper and lower cutting rod. The cutting bench is provided with a knife carriage with cutting blade running back and forth over the cutting bench over the entire width of the fabric.

After cutting of the face-to-face fabric, both fabrics, i.e. the upper and lower fabric, are pulled out of the fabric area by a pull roll and evacuated respectively upwards and downwards.

The upper fabric lies at approximately 180° firmly against the (upper) pull roll (also called picker roll) in order to have good adherence to the pull roll so as to be evacuated under tension at a controlled speed without risk of slipping. Then, the upper fabric is guided over a guiding support that bends by 180° the upper fabric running out almost horizontally on the pull roll in order to stretch it out of the reach of the pull roll. There, the upper fabric is again bent by 90° to evacuate the fabric downwards, from where it is evacuated horizontally under the operator position together with the lower fabric (although with a shifted pattern because of the difference in distance run), in order to be led to the delivery location in the space behind the weaver.

The cutting bench that guides the cutting blade in its back and forth movement to cut the face-to-face fabric is located in the space bordered by the upper and lower pull roll, the face-to-face fabric and the vertically evacuated upper fabric. As all these parts are moving during normal operation of the weaving machine, the cutting bench can only be positioned by its extremities on the side frames of the weaving machine and this out of reach of the fabric.

At each cycle during the weaving process, after introduction of the one or more wefts, the weft yarns are pressed against the fabric border by the movement of the reed. This beat movement is accompanied by significant forces that generate vibrations and deformations on the machine frames. These vibrations and deformations are further transmitted to the cutting bench positioned on the machine frames. As the cutting bench cannot be supported between the machine frames, these vibrations and deformations, which are transmitted to the cutting bench from both sides of the machine frames, cause significant sagging of the cutting bench. This sagging becomes all the more significant with greater weaving speeds and when the force exerted during beat-up increases. The generated vibrations have a frequency of a multiple of the machine speed.

This leads to cutting of the face-to-face fabric in unequal upper and lower fabrics and uneven pile height in a carpet. As, at a same machine speed, sagging of the cutting bench remains constant at every position in the width of the weaving machine when the cutting blade passes through that position, this provides a wave-like character to the cut in lateral direction, whereas at every position in the lateral direction the pile height remains the same in longitudinal direction. At low weaving speeds, this defect only has a limited impact on the quality of the fabric.

However, at high fabric speeds and when significant forces are present due to the beat movement of the reed, this produces fabrics of lower quality, which must be submitted to expensive further processes to shave off the pile yarns that stand out above the other pile yarns, in order to obtain a fabric with even pile height. This is also a waste of expensive pile yarn material.

As already mentioned, at constant fabric speed, sagging of the cutting bench is constant at each position in the width of the weaving machine when the cutting blade passes through. This means that, at constant weaving speed, a wave effect is created in both fabrics (upper and lower fabric) in the lateral direction of the weaving machine, which at lower machine speeds is not immediately apparent to the eye.

However, when the machine is restarted after a stop and when full weaving speed is not yet reached in the first cutting cycle, this sagging pattern is no longer equal and on these fabric lines that are cut during starting of the machine, it will be clearly visible that pile height differs from the previously and subsequently cut fabric lines. In weft direction, this introduces unacceptable lines in the fabric. The so-realized fabrics are of lesser quality or they must be discarded.

To increase the stiffness of the cutting bench, it is known from German patent publication DE 3 104 970 that the shape of the cutting bench positioned by its extremities on the machine frame can be adapted. However, this solution reduces sagging of the cutting bench only to a limited extent.

SUMMARY OF THE INVENTION

The purpose of this invention is to provide a face-to-face weaving machine where the cutting bench no longer shows or at least significantly reduces the above-mentioned disadvantages.

The purpose of the invention is met by providing a face-to-face weaving machine comprising a cutting bench to guide the movement of a cutting blade in order to cut a face-to -face fabric, wherein said cutting bench is carried and/or supported at its extremities by the frame of the weaving machine and in that, at least at one additional location between said extremities, said cutting bench is carried and/or supported by the frame. In a preferred embodiment of the invention, the cutting bench is connected at least at one additional location by way of one or more intermediate parts to the frame of the weaving machine. By this, we obtain a face-to-face weaving machine with a cutting bench that possesses sufficient stiffness to significantly reduce sagging of the cutting bench. This will produce upper and lower fabrics with even pile height.

In a preferred embodiment of the face-to-face weaving machine according to the invention, the weaving machine comprises at least one guiding support to guide the fabric, and the cutting bench is connected to a guiding support at a location between its extremities. The cutting bench is preferably connected to the upper and/or lower guiding support at a location between its extremities.

In a particularly advantageous embodiment of the weaving machine according to the invention, the cutting bench is connected to the frame of the weaving machine by way of one or more intermediate parts by means of at least one connecting plate.

In a preferred embodiment, the guiding support for guidance of the upper fabric is composed of a number of tubes, preferably two, on which the fabric is guided. These tubes are attached to the machine frame at both sides of the machine. As these tubes can neither be supported between the machine frames, because they are surrounded by moving parts, they are preferably provided with stiffening bars for reinforcement, in order to limit sagging of the guiding support as a result of the exerted forces and associated vibrations and deformations. In a preferred embodiment of the face-to-face weaving machine according to the invention, the cutting bench is connected to said stiffening bar.

In a particularly advantageous embodiment of the weaving machine according to the invention, the shape of the guiding support can be adapted, so that the stiffening bar of the guiding support connects to the cutting bench over the entire width or at least over part of the width of the weaving machine. The additional stiffness provided to the guiding support by such connection allows re-dimensioning of the stiffening bar of the guiding support.

In a more particular embodiment of the weaving machine according to the invention, the guiding support is executed as a freely rotatable roll, provided with integrated support positions connected to the cutting bench. By integrated support position is meant that, at one or more locations in the width of the weaving machine, a support, possibly with a bearing, must be incorporated in the tube that serves as guiding support, so that the outer diameter of the support position, whether or not provided with a bearing, is more or less equal to or smaller than the diameter of the roll over which the fabric is drawn. The other side of the support position is connected to the cutting bench.

In a preferred embodiment of the weaving machine according to the invention, the weaving machine comprises a support profile carried and/or supported at its extremities by the frame of the machine, wherein, at least at one additional location between its extremities, the cutting bench is connected to said support profile. This support profile is preferably a crossbar provided at the bottom of the weaving machine, under the lower pull roll.

In a most particular embodiment of the weaving machine according to the invention, the cutting bench is connected between its extremities to the upper guiding support and/or the support profile. Preferably, single-piece connections will be provided that connect the upper guiding support, the cutting bench and the lower support profile to one another.

In a particularly preferred embodiment of the weaving machine according to the invention, the connection between the cutting bench and the guiding support and/or the support profile is realized in the space created by the face-to-face fabric, the upper and lower guiding support and the vertically evacuated upper fabric.

This invention is further clarified below in the more detailed description of some embodiments of a face-to-face weaving machine according to this invention. Nothing from this description may be interpreted as a limitation of the protection sought by the claims.

BRIEF DESCRIPTION OF THE DRAWINGS

In this description, reference is made by means of reference numbers to the enclosed drawings, in which.

DETAILED DESCRIPTION OF THE PREFERRED EMBODIMENTS

Figure 1:
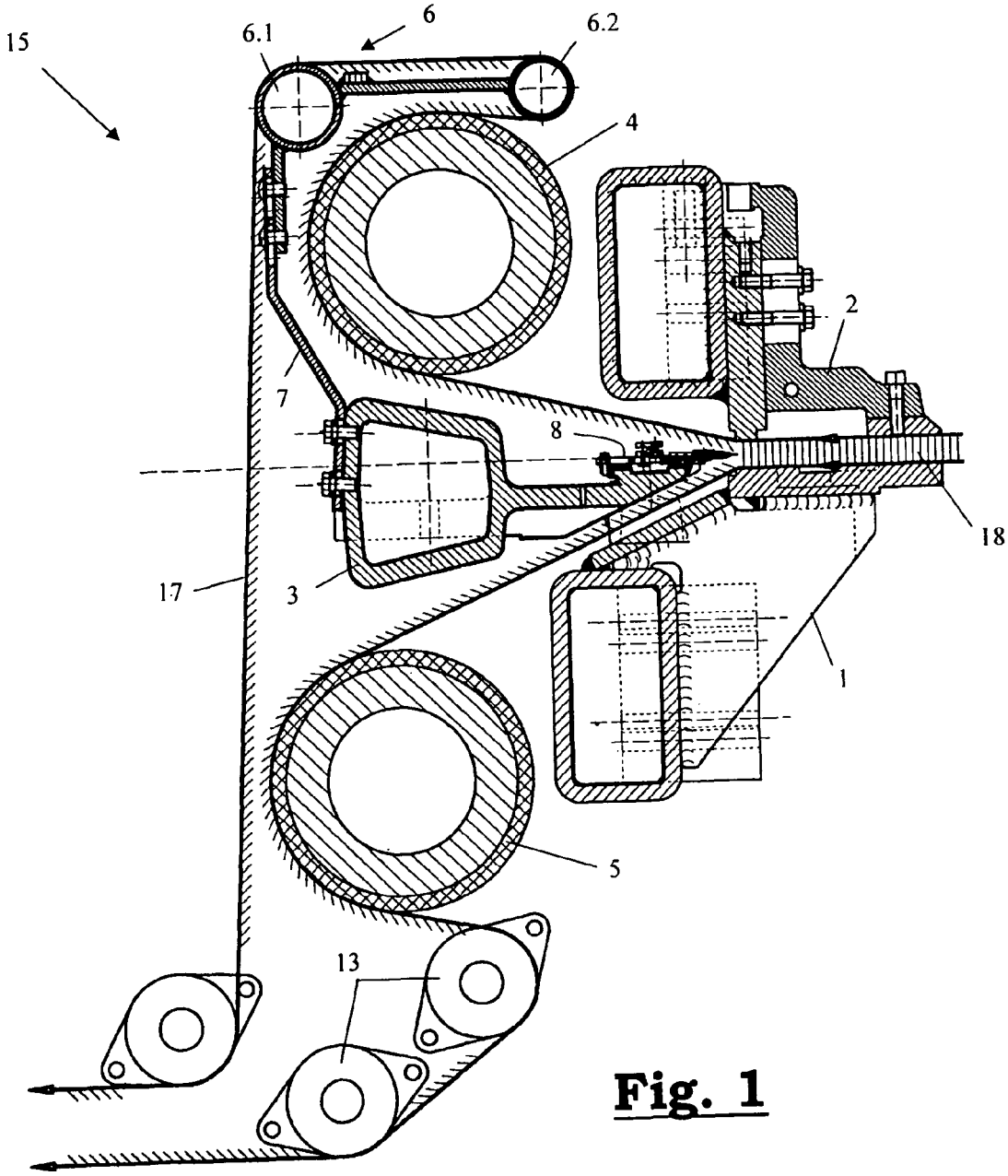
FIG. 1 is a side view of the weaving machine in which the cutting bench is connected by several connecting plates to the guiding support.

The face-to-face weaving machine (15) according to the invention and as presented in the figures comprises a cutting bench (3) to guide the movement of a cutting blade in order to cut a face-to-face fabric (18) held apart over the distance between the upper (2) and lower cutting rod (1). For this, the cutting bench (3) is provided with a knife carriage with a cutting blade (8) moving back and forth over the cutting bench over the entire width of the fabric.

The cutting bench (3) that guides the cutting blade in its back and forth movement in order to cut the face-to-face fabric (18) is located in the space bordered by the non-separated face -to-face fabric (18), the upper (6) and lower guiding support (13) and the vertically evacuated upper fabric (17). For this reason, in the previous art, the cutting bench was only carried and/or supported at its extremities (16) by the side frames (11) of the weaving machine (15). Because of this, the cutting bench of a systems according to the previous art is submitted to significant sagging created by the forces generated during the beat movement.

To significantly reduce sagging of the cutting bench (3), the cutting bench (3) according to the invention is connected to the machine (15) at least at one additional location between its extremities (16) frame by way of one or more intermediate parts.

Figure 4:
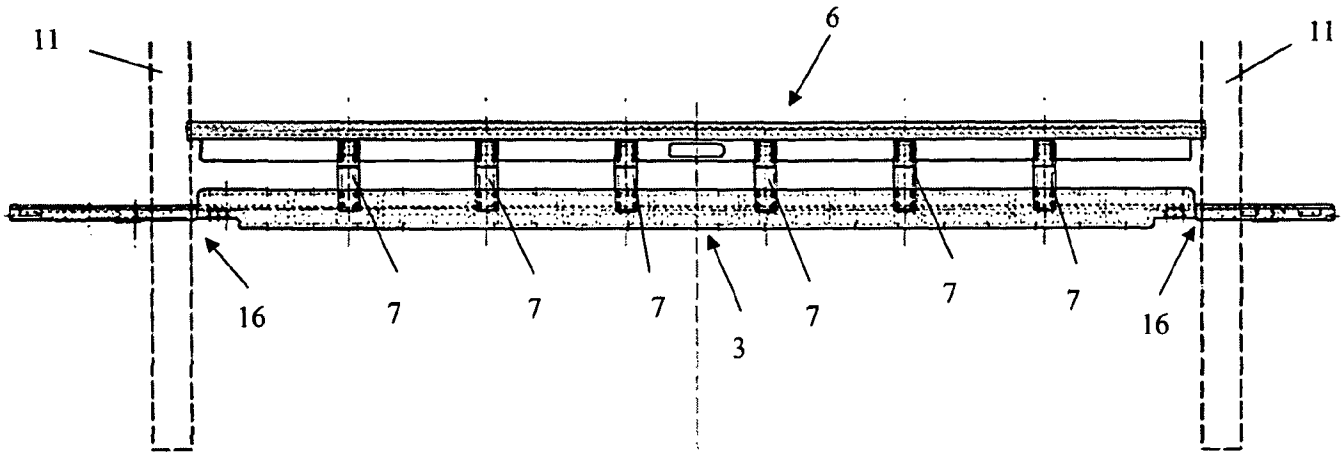
FIG. 4 is a front view of the weaving machine presented in FIG. 1.

As presented in FIGS. 1 and 4, the cutting bench (3) is supported by connections (7) to be realized to the upper guiding support (6) that guides the upper fabric from the position where the fabric leaves the upper pull roll (4) to where the fabric moves down vertically behind the cutting bench (3). If necessary, during its downward guidance, the fabric can be brought somewhat further towards the weaver in order to obtain sufficient space to incorporate these connections (7). The connection is preferably realized by installing one or more connecting plates (7).

The upper guiding support (6) is composed of a number of tubes (6.1 and 6.2) over which the fabric is guided. These tubes (6.1, 6.2) are also attached to the machine frame (11) at both sides of the machine (15). As they are surrounded by moving parts, they are provided with stiffening bars (14) for reinforcement in order to limit sagging of these tubes as a result of the exerted forces and associated vibrations. Accordingly, the cutting bench (3) can be connected with the above-mentioned stiffening bar (14).

Figure 2:
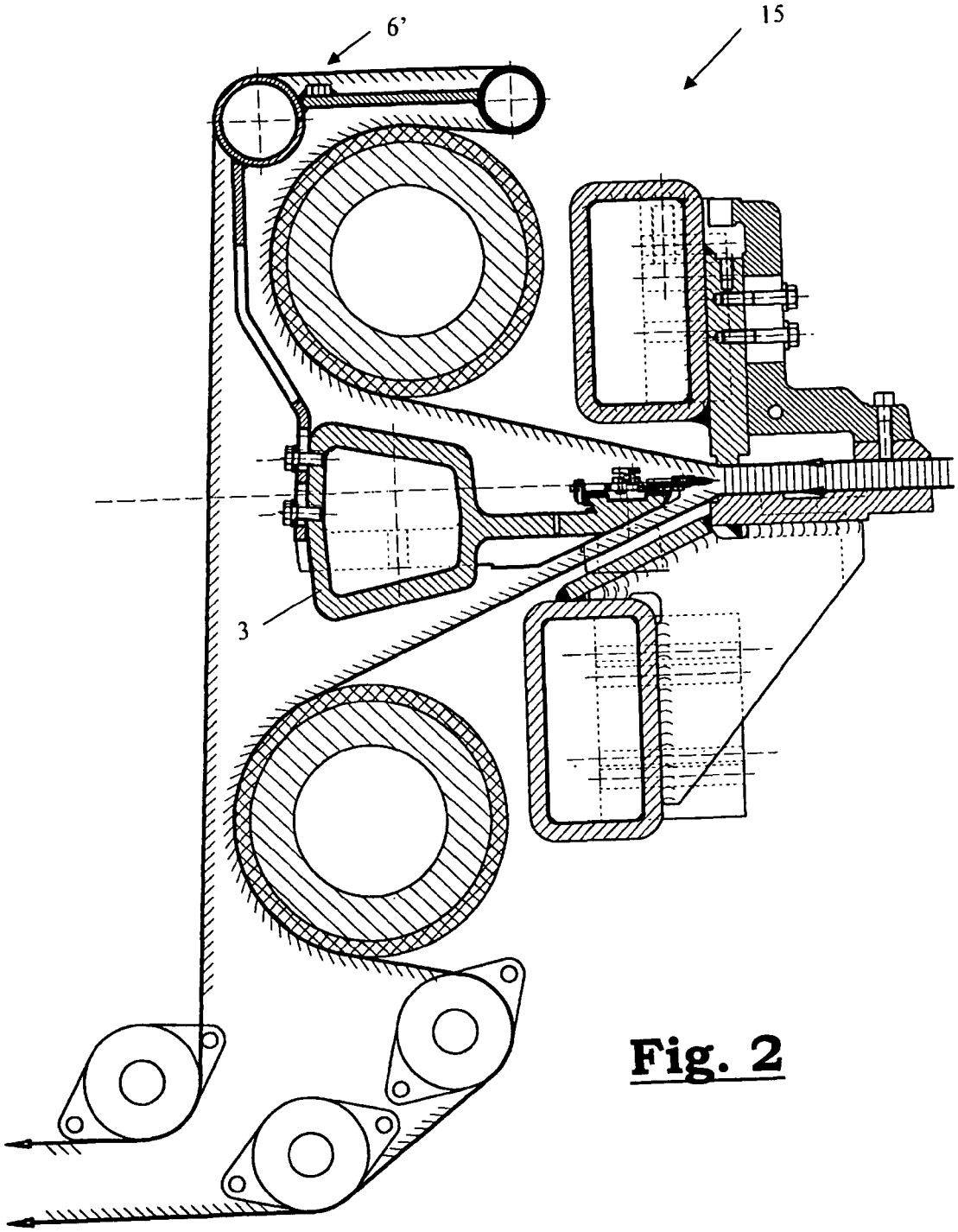
FIG. 2 is a side view of the weaving machine in which the shape of the stiffening bar of the guiding support is adapted to be connected directly and at several locations to the cutting bench.
Figure 5:
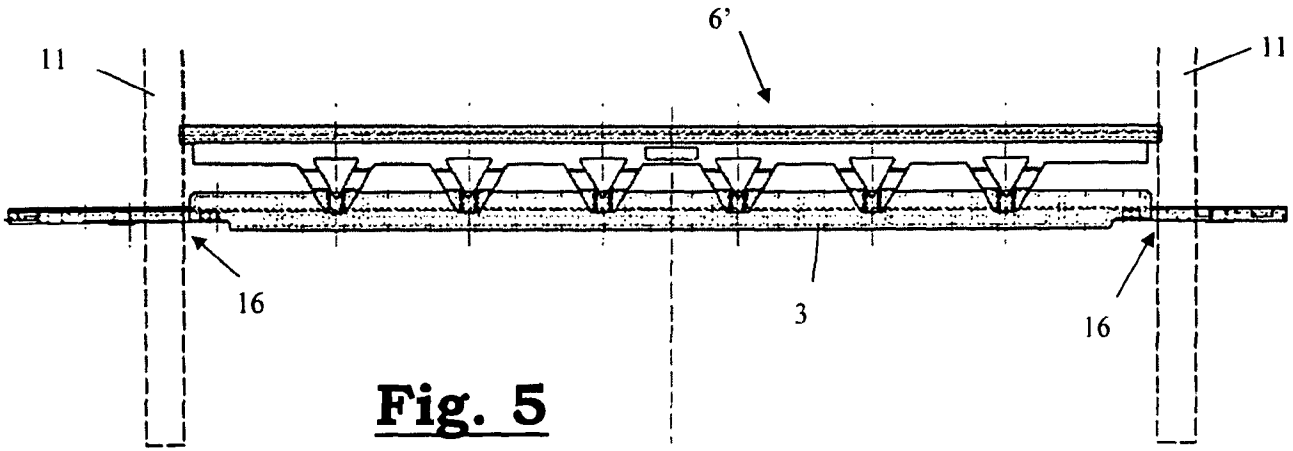
FIG. 5 is a front view of the weaving machine presented in FIG. 2.

Another solution is presented in FIGS. 2 and 5. It is obtained by adapting the shape of the stiffening bar of the guiding support (presented by reference number 6') so that the guiding support (6') can be connected directly to the cutting bench (3) over the entire width or over part of the width of the weaving machine (15). The additional stiffness provided to the guiding support (6') by such connection to the cutting bench (3) allows re-dimensioning of the stiffening bar of the guiding support.

The guiding support (6) can also be executed as a freely rotatable roll, provided with integrated support positions connected to the cutting bench (3). By integrated support is meant that, at one or more locations in the width of the weaving machine (15), a support, possibly with a bearing, is integrated in the tube that serves as guiding support, so that the outer diameter of the support position (whether or not provided with a bearing) is more or less equal to or smaller than the diameter of the roll over which the fabric is drawn. The other side of the support position is connected to the cutting bench (3).

Figure 3:
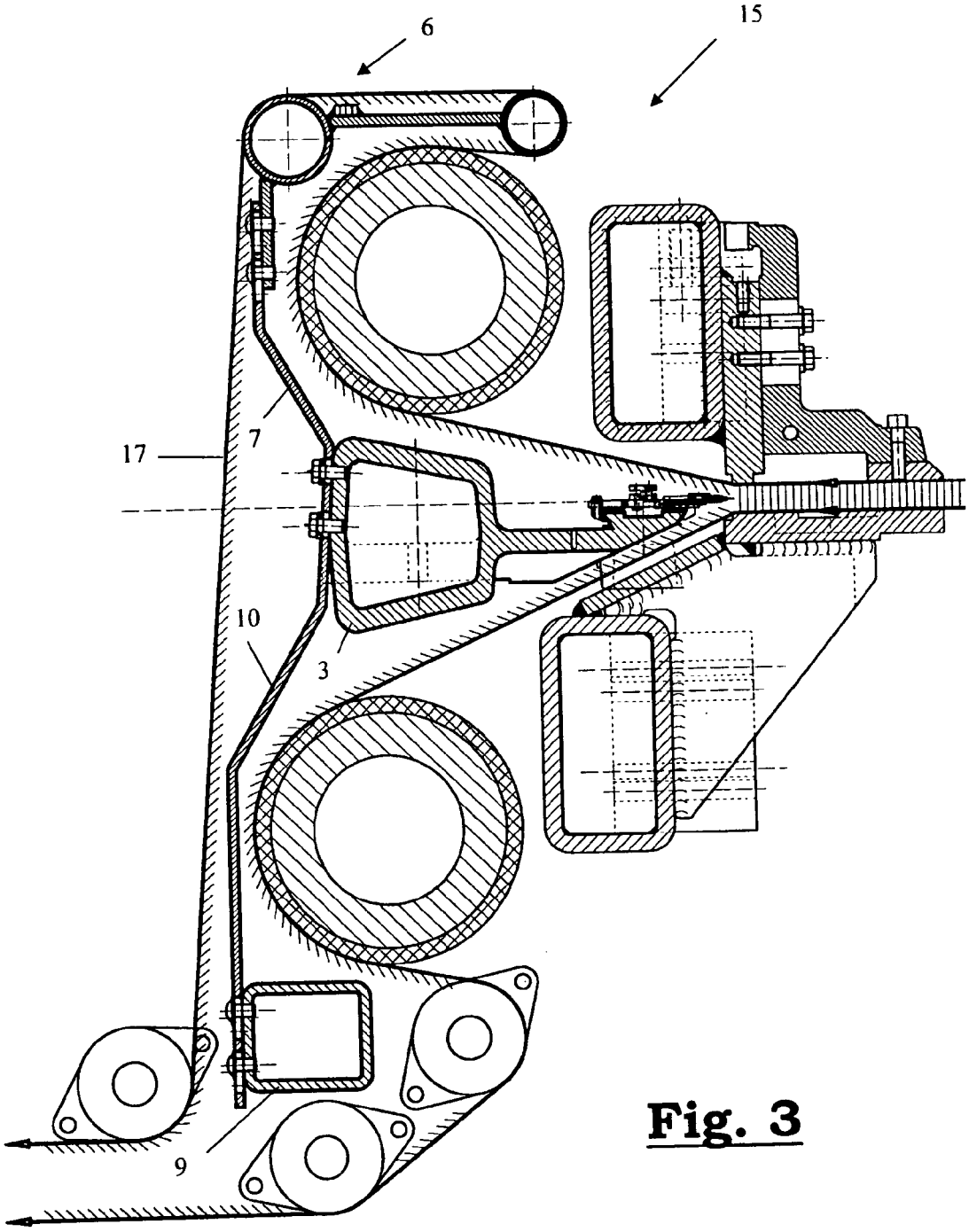
FIG. 3 is a side view of the weaving machine in which the cutting bench is connected to the upper guiding support and the lower crossbar.
Figure 6:
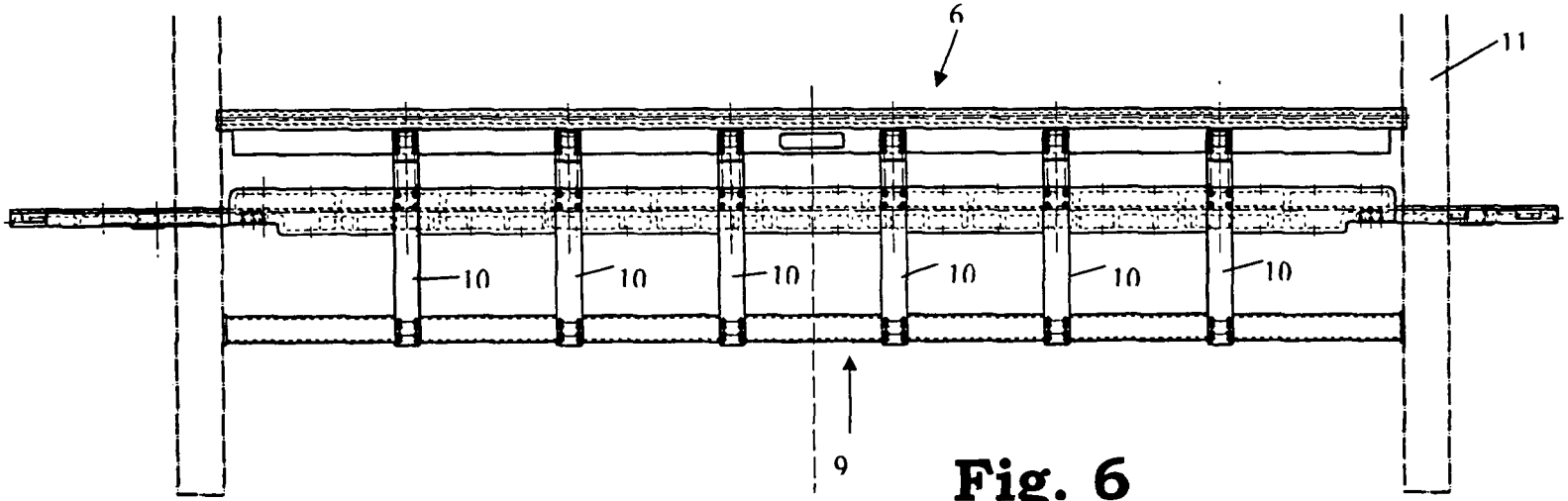
FIG. 6 is a front view of the weaving machine presented in FIG. 3.

As presented in FIGS. 3 and 6, stiffness of the cutting bench can be further increased by providing an additional support profile (9) at the bottom of the weaving machine (15), preferably under the lower pull roll (5) and by connecting the cutting bench (3) to this support profile (9). Said support profile (9) is carried or supported at its extremities by the side frames (11) of the machine (15). In a preferred embodiment, the lower guiding support (13) can take over the function of the support profile (9).

Figure 7:
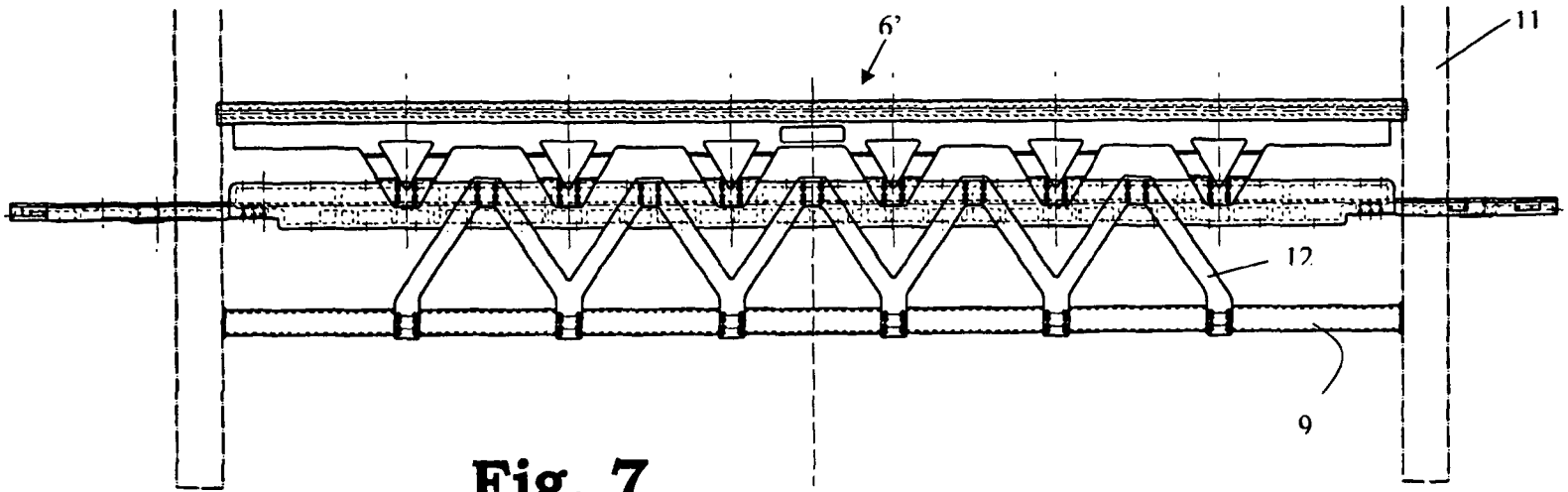
FIG. 7 is a front view of the weaving machine in which the embodiment in FIG. 5 is combined with a single-piece connection to the lower crossbar.

Both connections, i.e. between the cutting bench and, on the one hand, the upper guiding support (6) and, on the other hand, the support profile can be provided simultaneously. In addition, as shown in FIG. 7, single-piece connecting supports can be provided, which connect the upper guiding support (6), the cutting bench (3) and the lower crossbar to one another.

The invention claimed is:

1. A face-to-face weaving machine (15) comprising a cutting bench (3) to guide the movement of a cutting blade in order to cut a face-to-face fabric (18), wherein said cutting bench (3) is carried and/or supported at its extremities (16) by the frame (11) of the weaving machine (15) and characterized in that, at least at one additional location between said extremities (16), said cutting bench (3) is carried and/or supported by the frame (1).

2. Face-to-face weaving machine (15) according to claim 1, characterized in that, at least at one additional location, the cutting bench (3) is connected to the frame (11) of the weaving machine (15) by way of one or more intermediate parts.

3. Face-to-face weaving machine (15) according to claim 1, characterized in that the weaving machine (15) comprises at least one guiding support (6,13) to guide the fabric, and in that, at least at one location between its extremities (16), the cutting bench (3) is connected to a guiding support (6,13).

4. Face-to-face weaving machine (15) according to claim 3, characterized in that, at least at one location between its extremities (16), the cutting bench (3) is connected to an upper (6) and/or lower guiding support (13).

5. Face-to-face weaving machine (15) according to claim 3, characterized in that the guiding support (6,13) comprises at least one stiffening bar (14), and in that the cutting bench (3) is connected to said stiffening bar (14).

6. Face-to-face weaving machine (15) according to-claim 2, characterized in that the cutting bench (3) is connected to the frame (11) of the weaving machine (15) by way of one or more intermediate parts by means of at least one connecting plate (7).

7. Face-to-face weaving machine (15) according to claim 1, characterized in that the weaving machine (15) comprises a support profile (9) carried and/or supported at its extremities by the frame (11) of the machine (15), and in that, at least at one additional location between its extremities (16), the cutting bench (3) is connected to said support profile (9).

8. Face-to-face weaving machine (15) according to claim 7, characterized in that the cutting bench (3) is connected between its extremities (16) to the upper guiding support (6) and/or the support profile (9).

9. Face-to-face weaving machine (15) according to claim 2, characterized in that the connection between the cutting bench (3) and the one or more intermediate parts is realized in the space created by the face-to-face fabric (18), the upper (6) and lower guiding support (13) and the vertically evacuated upper fabric (17).

* * * * *